United States Patent [19]

Bartels

[11] Patent Number: 4,793,471

[45] Date of Patent: Dec. 27, 1988

[54] FURNACE GRATE STRUCTURE

[75] Inventor: Martin Bartels, Stuttgart, Fed. Rep. of Germany

[73] Assignee: Deutsche Richard Kablitz Gesellschaft fur Okonomie der Dampferzeugungskosten und Feuerungskontrolle Richard Kablitz GmbH & Co. KG, Fed. Rep. of Germany

[21] Appl. No.: 36,109

[22] Filed: Apr. 8, 1987

[30] Foreign Application Priority Data

Apr. 12, 1986 [DE] Fed. Rep. of Germany ..... 3612391

[51] Int. Cl.[4] ..... B65G 25/00

[52] U.S. Cl. ..... 198/774; 414/156; 110/281; 110/328; 126/152 B; 432/134

[58] Field of Search ..... 34/164; 110/278, 281, 110/289, 291, 328; 126/152 A, 152 B, 152 R, 163 R; 432/134; 414/156; 198/773, 774, 775

[56] References Cited

U.S. PATENT DOCUMENTS

| | | | |
|---|---|---|---|
| 1,165,793 | 12/1915 | McClave | 110/291 |
| 1,689,092 | 10/1928 | Weingartner | 110/291 |
| 2,700,849 | 2/1955 | Klotzbach | 126/152 R |
| 3,014,439 | 12/1961 | Mitchell et al. | 126/163 R |
| 4,569,437 | 2/1986 | Doerges | 110/281 X |
| 4,638,905 | 1/1987 | Weiss | 110/281 X |
| 4,676,176 | 6/1987 | Bonomelli | 110/291 X |

FOREIGN PATENT DOCUMENTS

| | | | |
|---|---|---|---|
| 97722 | 1/1964 | Denmark | 110/281 |

*Primary Examiner*—Robert J. Spar
*Assistant Examiner*—Cheryl L. Gastineau
*Attorney, Agent, or Firm*—Wigman & Cohen

[57] ABSTRACT

A furnace grate structure for a furnace or incinerator on which solid fuel advances in an advancing direction has at least two parallel grate beams extending substantially transversely to the advancing direction, the beams being mounted on a substructure and forming upwardly facing support structures. The grate beams form grate beam sections with gaps formed between the end surfaces of adjacent grate beam sections. The gaps are covered by a covering device and a recess is provided in the end surfaces of the grate beam sections to receive the covering device.

12 Claims, 10 Drawing Sheets

Fig.7
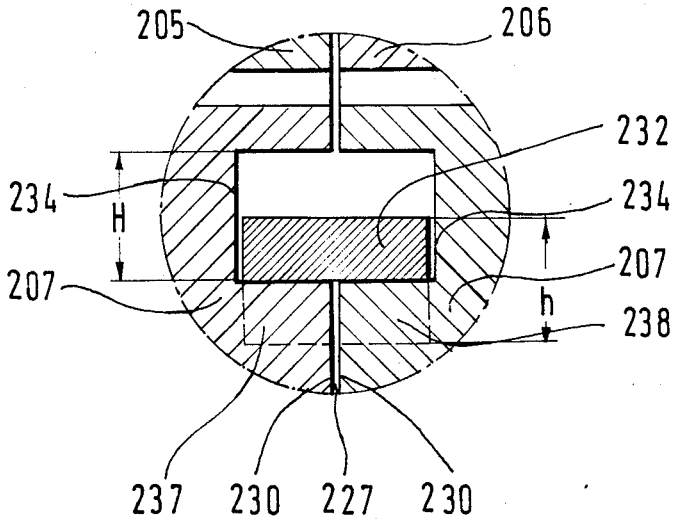
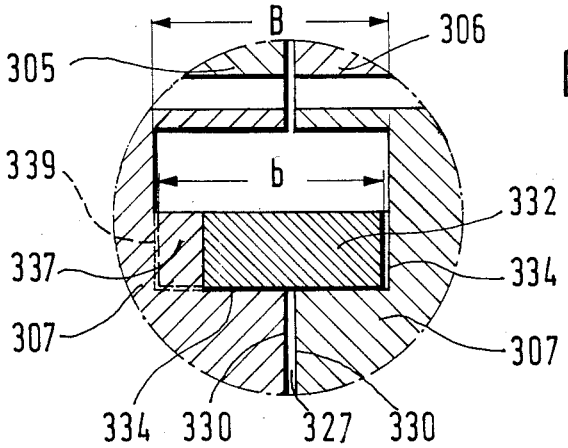
Fig.8
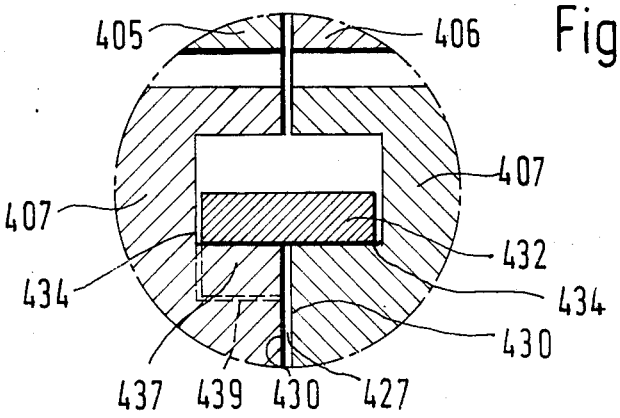
Fig.9

FURNACE GRATE STRUCTURE

BACKGROUND OF THE INVENTION

The present invention relates to a furnace grate structure over which solid fuel advances in a direction of conveyance as the fuel is combusted, and more particularly to a furnace grate structure having a plurality of grate beams extending substantially parallel to one another and substantially transversely to the direction of conveyance, with the grate beams being supported on a substructure.

At least one bank of elongated grate bars of the furnace grate structure extend substantially parallel to the direction of conveyance in spaced relation to each other. Upwardly facing support surfaces of the grate bars are inclined downwardly in said direction of conveyance for conveying the solid fuel. Each of the bars is supported at each end thereof on a mounting surface of a respective grate beam, such that some of grate bars are reciprocatingly movable in a substantially horizontal direction and the other grate bars are stationary.

By means of the fact that several banks of grate bars can be arranged one behind the other like steps, the grate structure is thereby subdivided. A particularly beneficial and adaptable stirring effect is achieved when some of the grate bars are moved back and forth in a substantially horizontal direction. By regulating the grate movement in the individual banks of grate bars, inclined grate structures of this type can be adapted to the characteristics of various fuels.

Because of the high thermal loads to which such inclined grate structures are subjected, the grate beams serve primarily as a framework to support the grate bars on the substructure which is made of steel and cannot withstand the thermal loads. For this reason, the grate beams generally consist of a grey cast iron that can withstand the thermal loads.

A furnace grate structure of this type is described in U.S. Pat. No. 4,638,905, assigned to the same assignee as the present invention, where at least one of the grate beams comprises a plurality of grate beam sections, which are arranged end to end on said substructure to form a grate beam having gaps between adjacent grate beam sections.

According to the U.S. Pat. No. 4,638,905, keyed engagement means are provided on said grate beam sections for guiding and laterally positioning the reciprocatingly movable and said stationary grate bars such that each of the gaps between the adjacent ends of said grate beam sections are covered by preferably stationary grate bars.

In the preferred embodiment of the afore-mentioned patent, the gaps between the adjacent grate beam sections are covered by stationary grate bars in which each of the shortest grate beam sections supports two stationary grate bars partly for covering the gap between the adjacent grate beam sections and between the stationary grate bars one grate bar being reciprocatingly movable parallel to the direction of conveyance.

In said known inclined grate, the lateral arrangement o the grate bars mounted on the grate beams is fixed because the separating gaps between the adjacent grate beam sections must be covered by the stationarily mounted grate bars.

Furthermore, in the known inclined grate, every grate beam section must be capable of supporting two stationary grate bars partly and between them at least one reciprocating grate bar, thus limiting the shortest length of each grate beam section and the flexibility of the furnace grate structure.

Finally, because of the displaced arrangement of the grate bars on the grate beam sections in the known inclined grate, special and different end sections for abutment against the side walls of the furnace chamber are necessary, so that it is always necessary to provide three different shapes of grate beam sections for a variable-length grate beam.

SUMMARY AND OBJECTS OF THE INVENTION

In view of the foregoing limitations and shortcomings of the prior art devices, as well as other disadvantages not specifically mentioned above, it should be apparent that there exists a need in the art for an improved furnace grate structure. It is, therefore a primary object of this invention to fulfill that need by providing a furnace grate structure in which the length of the grate beam sections is independent of the grate bars so that grate bar sections of an optionally short length are possible.

More particularly, it is an object of this invention to provide a covering of the gaps between the adjacent ends of the grate beam sections independently from the grate bars.

It is another object of the invention to provide a recess in at least one endface of at least one grate beam section for receiving a covering means for covering the adjacent gaps.

Briefly described, the aforementioned objects are accomplished according to the invention by providing a projection of an adjacent grate beam section or a separate strip to cover the gap between adjacent sections. This has the advantage over the known inclined grate, which has grate beam sections that support the horizontally movable as well as the stationarily mounted grate beams, that the separating gaps no longer need to be covered by the stationarily mounted grate bars, so that the grate bars mounted on the grate beams can be arranged in any desired manner laterally to the direction of conveyance. Accordingly, it is also possible to select an arrangement in which each grate beam section supports only one grate bar, or in which one grate bar is mounted on several adjacent grate beam sections. In this manner the smallest possible units of identical grate beam sections can be realized, which, when lined up, form grate beams whose lengths can be optimally adapted for installation in whatever furnace chamber is provided.

In this manner it can also be achieved that, in contrast to the known inclined grate, every second grate bar mounted on the grate beam no longer need be capable of reciprocating horizontally, but rather that, depending on the individual circumstances of use, grate bars that can be moved on the grate beam and those that are stationarily mounted can be lined up together in any desired manner. Accordingly, for example, a row of adjacent grate bars can be provided on the grate beam in which only every third grate bar is stationarily mounted.

The recesses to receive the covering means can be upwardly open. It is also possible for a grate beam section to have a recess in each of its two end surfaces. In this manner it can be provided that these recesses are arranged at the same elevation in the two end surfaces of each grate beam section, so that facing end surfaces of grate beam sections of this type form a channel, which can be upwardly either closed or open, serving to receive a strip serving as the covering means. This has the advantage that a particularly suitable material, such as a ceramic, can be used for the strip, which does not have to be the same material as that used for the grate beam sections. In case of a material defect, the strips are especially easy to replace, without it being necessary to disassemble the inclined grate, because the strips can simply be set or slid into place and can be removed just as easily.

Because of the displaced arrangement of the grate bars on the grate beam sections in the known inclined grate, special and different end sections for abutment against the side walls of the furnace chamber are necessary, so that there are always necessary three different shapes of grate beam sections for a variable-length grate beam. In the inclined grate according to the invention, in which the recesses are provided at the same elevation in both end surfaces of the grate beam section, the grate beam cross-section is symmetrical relative to its center plane running parallel and vertical to the direction of conveyance. This has the advantage that special end sections facing the side walls of the furnace chamber are unnecessary, so that different lengths of grate beams can be assembled from completely identical grate beam sections.

Detachable securing devices, such as screw connections or the like, can be provided to connect the covering devices with the grate beam sections.

However, the securing devices can also be formed by an interlock bar provided on the covering means, which interlock bar prevents a relative horizontal shifting movement between the covering means and the grate beam not connected with the securing device.

If upwardly open recesses are provided in the two end surfaces of a grate beam section, projections from respective adjacent grate beam sections, each of which has an interlock bar as a securing device which engages in the adjacent grate beam section, can engage in these recesses. The shape of these projections is adapted to that of the recesses and the projections serve as covering means. With this arrangement, the grate beam sections lying between the grate beam sections having the upwardly open recesses, can easily be set down into place and secured against horizontal shifting by means of the securing device.

In addition, for the mounting of the horizontally movable or fixed grate bars on the grate beam sections, the covering means can form ribs on the upper side of the grate beam sections, which ribs engage in cutouts in the grate bars, so that the covering means and the ribs form a single structural element.

With grate beam sections having two mounting surfaces successively arranged in the direction of conveyance for the mounting of the grate bars, the mounting surfaces lying downstream in the direction of conveyance are arranged lower than the mounting surfaces lying upstream.

In this manner it can be provided that at least one end surface of at least one grate beam section includes two recesses to receive covering means which are arranged at different elevations and extend in such a manner that the covering means engaging therein cover the gap between the grate beam sections, whereby the recesses, which can also be upwardly open, border the mounting surfaces.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIGS. 7 through 9 are enlarged detail views of the portion of modified third, fourth and fifth exemplary embodiments taken along circle V in the first exemplary embodiment in FIG. 4;

DETAILED DESCRIPTION OF A PREFERRED EMBODIMENT

Figure 1:
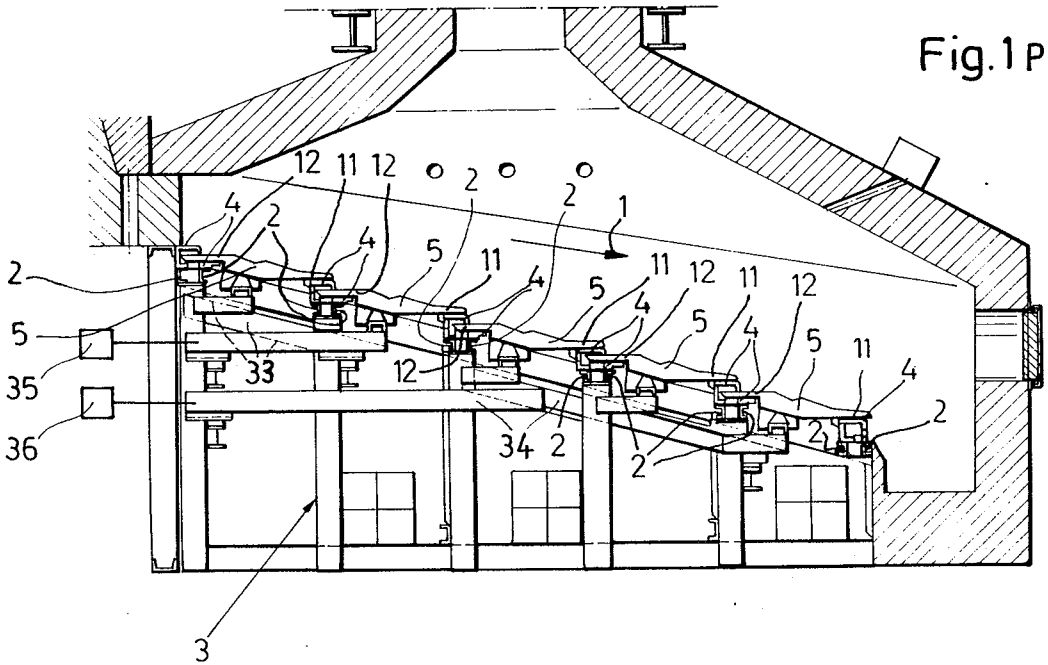
Fig. 1 PRIOR ART
FIG. 1 is a greatly simplified schematically illustrated cross-section through a known furnace with a known inclined grate illustrated in side view.

Referring now in detail to the drawings, the known inclined grate illustrated in FIG. 1, which is arranged in a furnace chamber illustrated in section, includes a lower frame, designated generally with numeral 3, having support rails 2 arranged in pairs. A grate beam 4 is mounted on each pair of support rails 2, which grate beam 4 extends essentially horizontally and perpendicular to the conveyance direction of the fuel (not illustrated) indicated in FIG. 1 by the arrow 1. The ends 11, 12 of horizontally movable grate bars 5 and solid grate bars 6 which are not visible in FIG. 1 are mounted on the grate beams 4.

Figure 2:
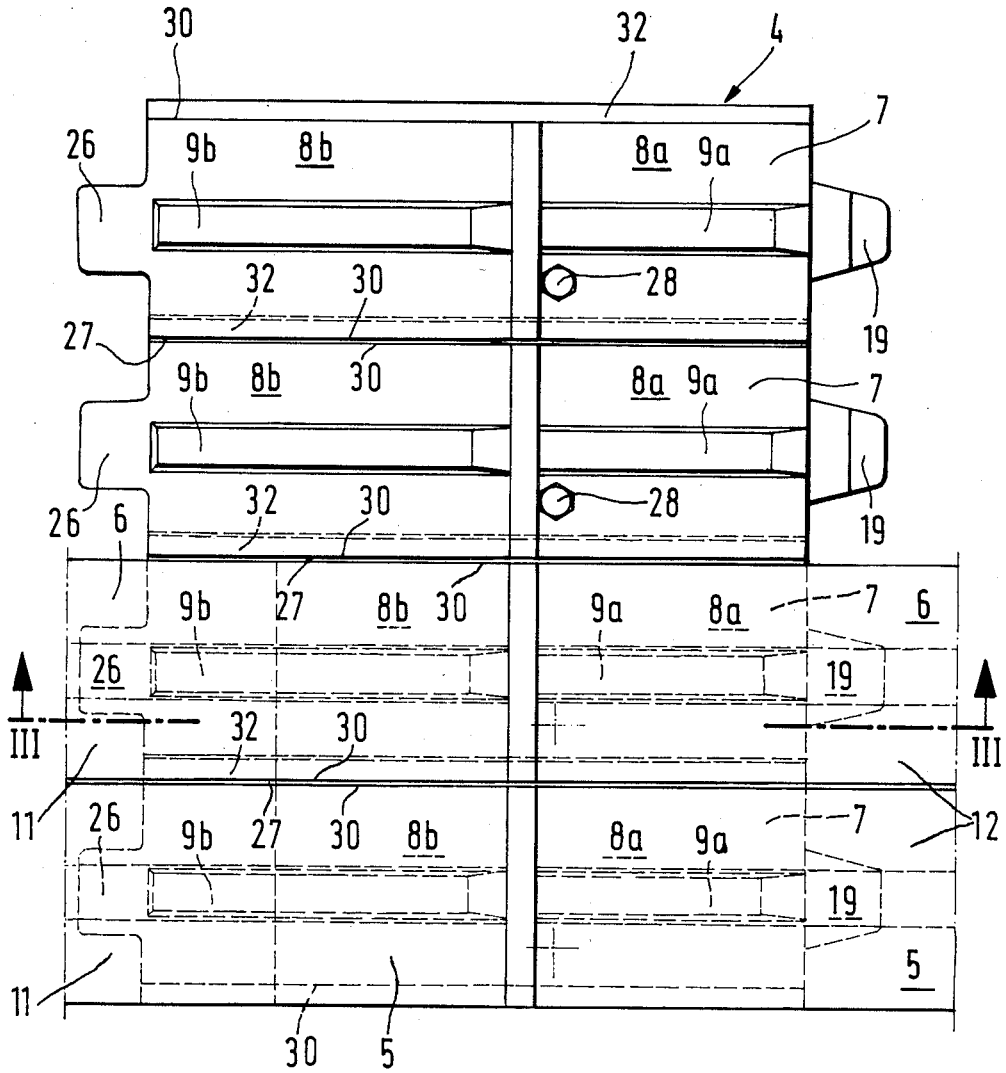
FIG. 2 is a plan view of a first exemplary embodiment of a grate beam made in accordance with the invention, comprised of four grate beam sections, whereby the ends of two pairs of grate bars are illustrated, which ends are supported by the grate beam sections shown in the lower portion of the drawing.

As can be seen from FIG. 2, the grate beam 4 in the first exemplary embodiment made in accordance with the invention is illustrated as having four grate beam sections 7, which are arranged in a straight line with abutting end surfaces 30. Each grate beam section is essentially the same length as the width of a grate bar 5 or 6.

Figure 3:
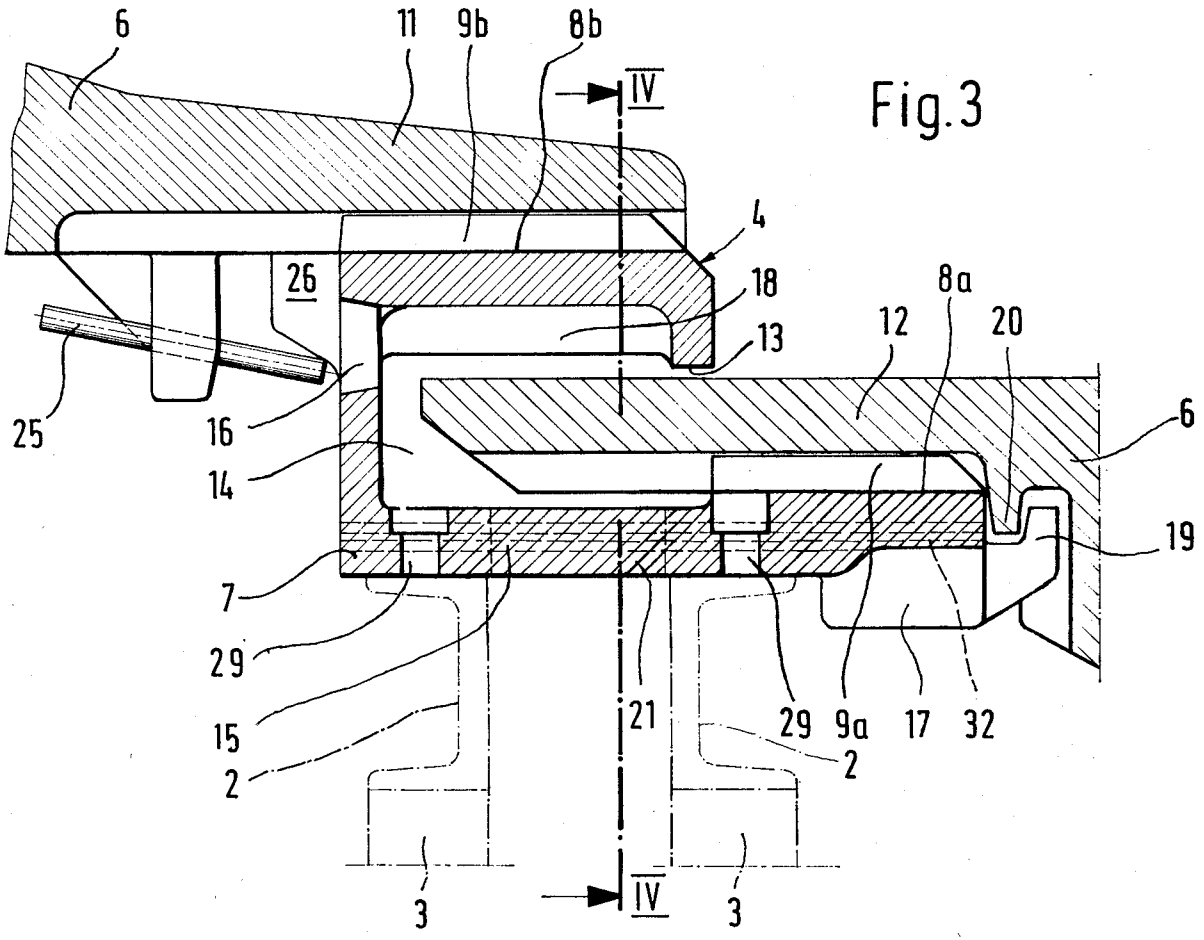
FIG. 3 is a cross-section according to the line III—III in FIG. 2.
Figure 4:
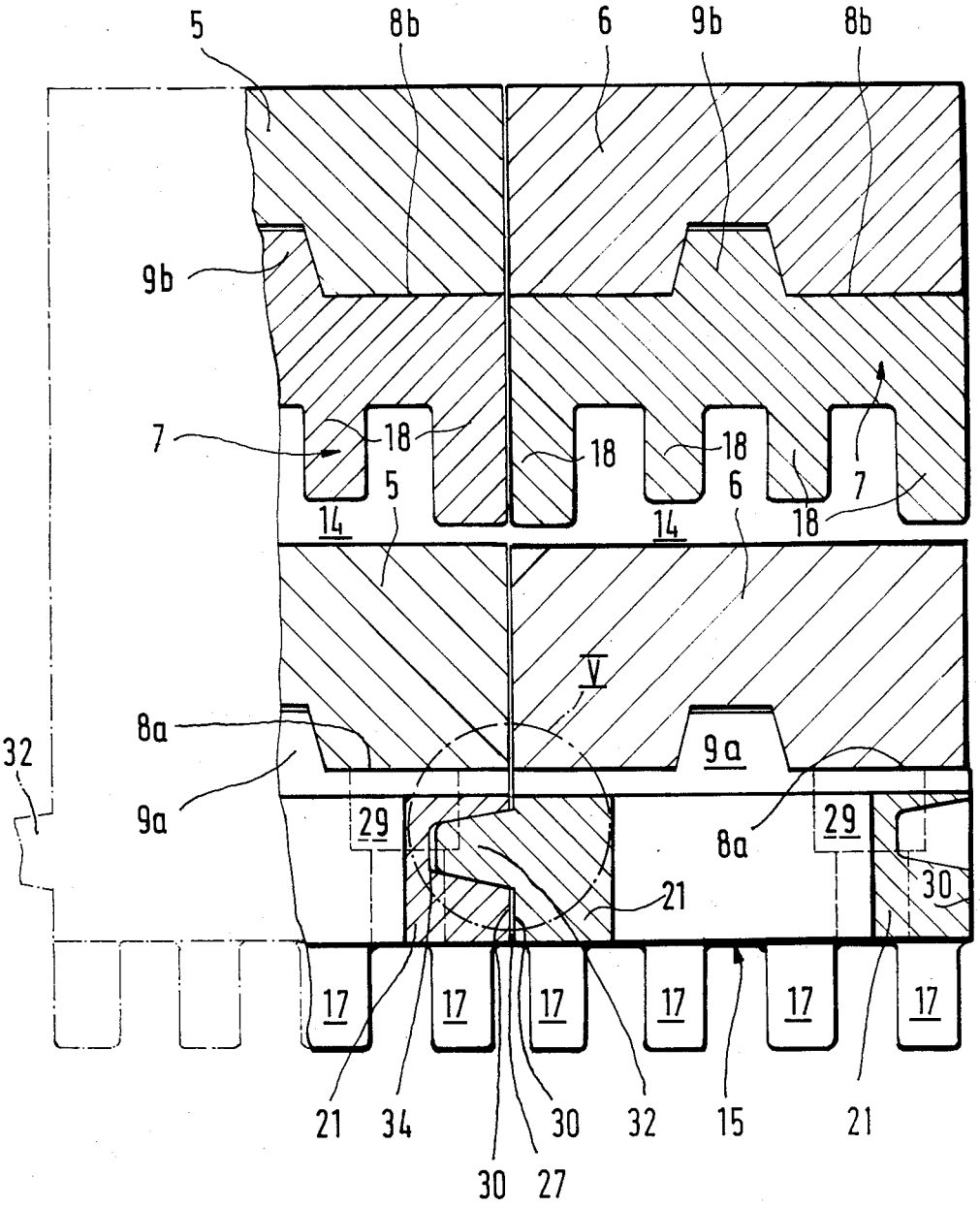
FIG. 4 is a cross-section according to the line IV—IV in FIG. 3.

Each of the grate beam sections 7 illustrated in FIG. 2 has two mounting surfaces 8*b* and 8*a* successively arranged in the direction of conveyance, and these mounting surfaces 8*b* and 8*a* serve for the mounting of the ends 11 and 12 of the grate beams 5 or 6 arranged upstream or downstram in the direction of conveyance. The mounting surfaces 8*a* lying downstream in the direction of conveyance lie lower than the mounting surfaces 8*b*. Ribs 9*a* and 9*b*, which extend parallel to the direction of conveyance over the entire width of the respective guide surfaces 8*a* and 8*b* are provided to guide and hold the horizontally movable and stationarily mounted grate bars 5, 6 on the mounting surface. Accordingly, as can be seen in FIG. 3, the grate bar 6 is rigidly connected with the grate beam section 7. For this purpose, the higher end 12 of the stationary grate bar 6, which end points opposite to the direction of conveyance, extends into a hollow chamber 14 of the grate beam section 7 through an opening 13 provided for this end 12 of the grate bar 6. The hollow chamber 14 is connected to the outside air for ventilation by means of a lower opening 15 and a rear slot 16, whereby outer and inner cooling ribs 17 and 18 are provided for the cooling of the grate beam section 7. The lower opening 15 is laterally bounded by two side walls 21 running parallel to the direction of conveyance (FIG. 4). The outer sides of these side walls 21 opposite the lower opening 15 lie in a plane with the two end surfaces 30 of the grate beam section 7.

To lock the upstream ends 12 of the fixed grate bars 6 together with the grate beam sections 7, hook-like projections 19 are provided on the grate beam sections 7 into which corresponding pins 20 of the fixed grate bars 6 engage (FIG. 3). These pins 20 are absent in the horizontally movable grate bars 5.

To lock the downstream ends 11 of the fixed grate bars 6, a rod 25 (FIG. 3) engages beneath a lug 26 on the grate beam section 7, so that the ends 11 of the fixed grate bars 6 supported on the mounting surface 8*b* of the grate beam sections 7 cannot lift away from the grate beam sections 7. In a known manner, (not shown) the movable grate bars 5 are connected with the immediately adjacent fixed grate bars 6 in a vertical plane parallel to the direction of conveyance in such a manner as to be essentially capable of horizontal movement but incapable of being lifted away.

In a known manner as shown in FIG. 1, the horizontally movable grate bars 5 are driven by one or more drive means 35 and/or 36 by means of carriers 33 and 34.

As can be seen particularly in FIGS. 2 and 4, grate beams 4 of any desired length can be assembled from the grate beam sections 7. To do so, one need only line up the desired number of grate beam sections 7.

As shown particularly in FIG. 4, the abutting end surfaces 30 of the grate beam sections 7 form gaps 27. In order to prevent hot fuel particles from falling onto the lower frame 3 through the respective gaps 27, it is provided, as shown in FIG. 4, that a horizontally running covering means extending over the entire width of the grate beam section 7 and formed on one end surface 30 of the grate beam section 7 as a projection 32 engages into the cut-out 34 formed in an adjoining end surface 30 of the adjacent grate beam section 7. This cut-out 34 is essentially adapted to the shape of the projection 32.

As can be seen in FIG. 4, in the first exemplary embodiment with an extended series of grate beams sections 7, in order to adapt the grate beam 4 to the inner size of the furnace chamber, the projection 32 shown at the left side in FIG. 4 abuts the side wall of the furnace chamber. However, if it is desired the fuel particles should rest on this projection 32, since the projection 32 is not covered by a grate bar 5 or 6, then a separate end section (not shown) must be provided on the left side of the arrangement according to FIG. 4 viewed in the direction of conveyance, which end section has no projection 32 on its left end surface 30. The left end surface of this end section, as viewed in the direction of conveyance, together with the left side surface of the grate bar mounted thereon, abuts the side wall of the furnace chamber.

In an embodiment that is slightly modified from the first exemplary embodiment, the side walls of the furnace chamber are formed in such a manner that in an arrangement according to FIG. 4, the left side wall of the furnace chamber, viewed in the direction of conveyance, has a cut-out 34 which is adapted to the projection 32 of the extreme left grate beam section 7, while the right side wall of the furnace chamber, viewed in the direction of conveyance, has a projection adapted to the cut-out 34 of the extreme right grate beam section 7. The left and right end surfaces 30 of the extreme left and right grate beam sections 7 of the grate beam 4 thereby abut the side walls of the furnace chamber.

In order to secure the grate beam sections 7 against undesired horizontal shifting relative to the lower frame 3, it is provided that the grate beam sections 7 are connected to the support rails 2 by four screws 28 (FIG. 2), which engage in bores 29 (FIG. 3). In the first exemplary embodiment, the projection 32, which extends horizontally over the entire width of the grate beam 7, can be provided on both end surfaces 30 of the grate beam section 7. In this version of the first exemplary embodiment, however, it is necessary that the two end surfaces 30 of adjacent grate beam sections 7 have cut-outs 34 adapted to the shape of the projections 32. In this version of the first exemplary embodiment, special end sections or adaptations of the side walls of the furnace chamber can be completely eliminated, if the grate beam sections 7 having the cut-outs 34 form the extreme right and left grate beam sections 7 abutting the side walls of the furnace chamber.

In the illustrations of the following exemplary embodiments in FIGS. 5 through 13, the elements corresponding to the first exemplary embodiment according to FIGS. 1 through 4, are designated with reference numerals increased by 100, so that by the use of these reference numerals, reference can be made to the description of the exemplary embodiment according to FIGS. 1 through 4.

In the exemplary embodiments shown in FIGS. 5 through 9, the horizontal recesses extending over the entire width of the grate beam sections on both end surfaces of each grate beam section are provided at the same elevation and are upwardly closed. If the end surfaces abut each other in grate beam sections of this type, the adjacent recesses form a channel that is upwardly closed and is provided for the reception of a strip serving as a covering means. A particularly suitable material, such as a ceramic or the like, is used for this strip. In order to prevent the strips from sliding out of the channels, the strips have detachable holding devices for connecting the strips with the grate beam sections.

Figure 5:
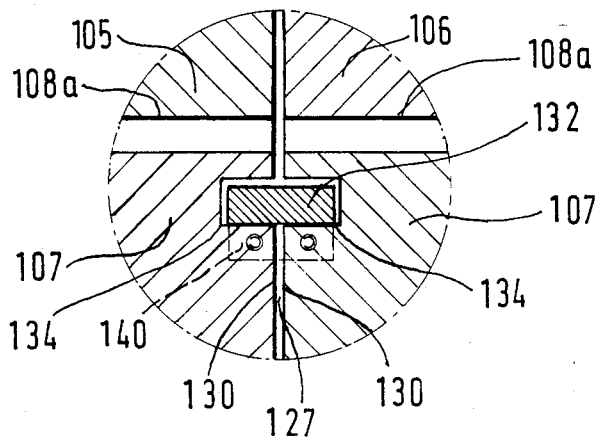
FIG. 5 is an enlarged detail view of the portion of a modified second exemplary embodiment of the invention, taken along circle V in the first exemplary embodiment in FIG. 4.
Figure 6:
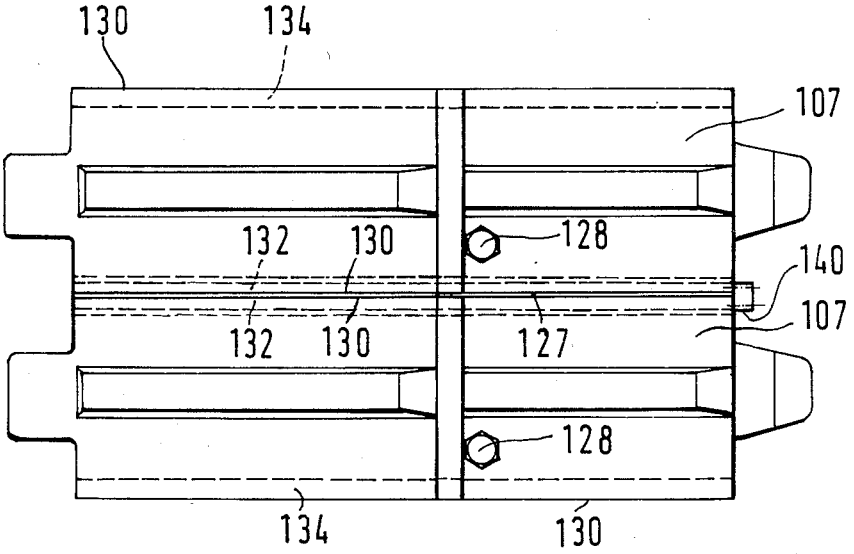
FIG. 6 is a plan view corresponding to that in FIG. 2 of the second exemplary embodiment of a grate beam which is comprised of two grate beam sections.

In the second exemplary embodiment shown in FIGS. 5 and 6, the strip 132 has a flange element 140 at one of its ends as a holding device. This flange element 140 is connected with the two side surfaces of the grate beam sections 107 by means of a screw connection.

In the third exemplary embodiment shown in FIG. 7, as a holding device, the strip 232 has at each end a downwardly extending projection to form an interlock bar 237. Each pair of interlock bars 237 produced in this manner form, on the facing sides thereof, stop surfaces 238, which, when the strip 232 is placed in the channel, rest against the side surfaces of two adjacent grate beam sections 207 with a degree of play. In order to be able to slide such a strip 232 into or out of the channel, it is provided that the vertical height H of the channel is somewhat larger than the vertical total height h of the combined strip 232 and interlock bar 237.

In the fourth exemplary embodiment illustrated in FIG. 8, the strip 332 has as a holding device an interlock bar 337 on one of its side surfaces. When the strip 332 is pushed into the channel, this interlock bar 337 form-fittingly engages in a cut-out 339 which is adapted to the shape of the interlock bar 337 and is arranged on one side surface of the recess 344. Also in the fourth exemplary embodiment it is necessary for the installation and removal of the strip 332, that the channel has an adequate height, as described above relative to the third exemplary embodiment. In addition, the horizontal width B of the portion of the channel in which the strip 332 is inserted or removed must be at least as large as the horizontal width b of the combined strip 332 and interlock bar 337.

In the fifth exemplary embodiment illustrated in FIG. 9, the interlock ba 437 which serves as the holding device is arranged on a lower side surface of the strip 432. This interlock bar 437, when the strip 432 is pushed into the channel, engages in a cut-out 439 adapted to its shape, which cut-out 439 is provided in a lower side surface of the recess 434.

Figure 10:
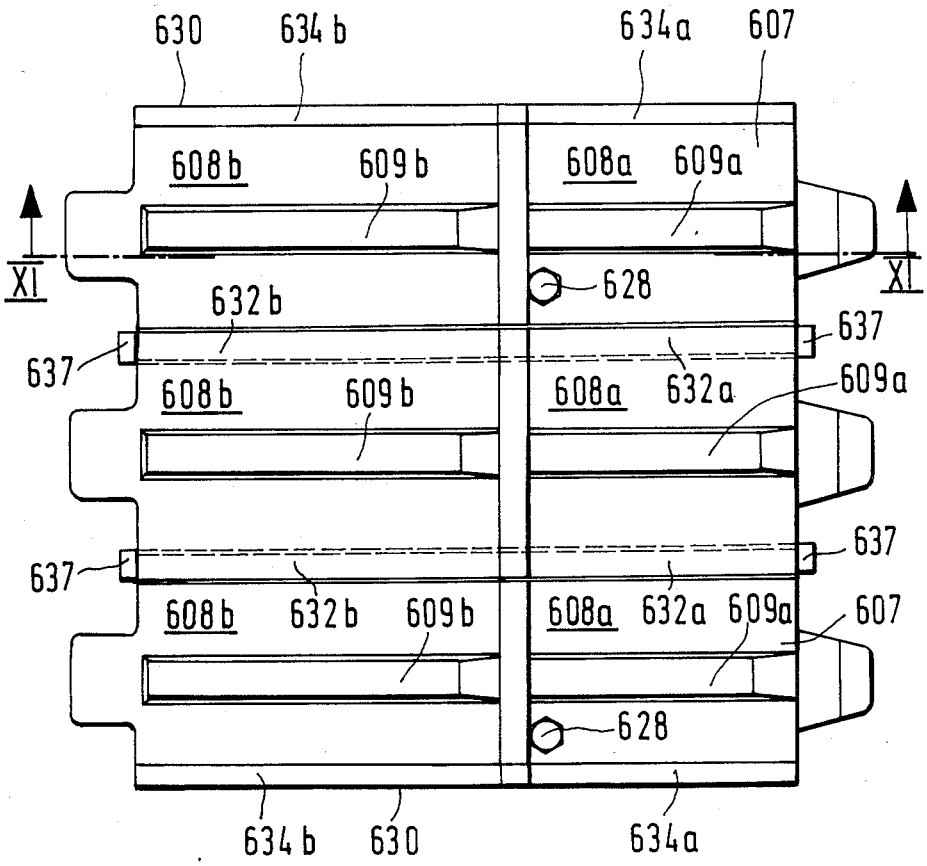
FIG. 10 is a top plan view corresponding to that in FIG. 2 of a sixth exemplary embodiment of a grate beam comprised of three grate beam sections.
Figure 11:
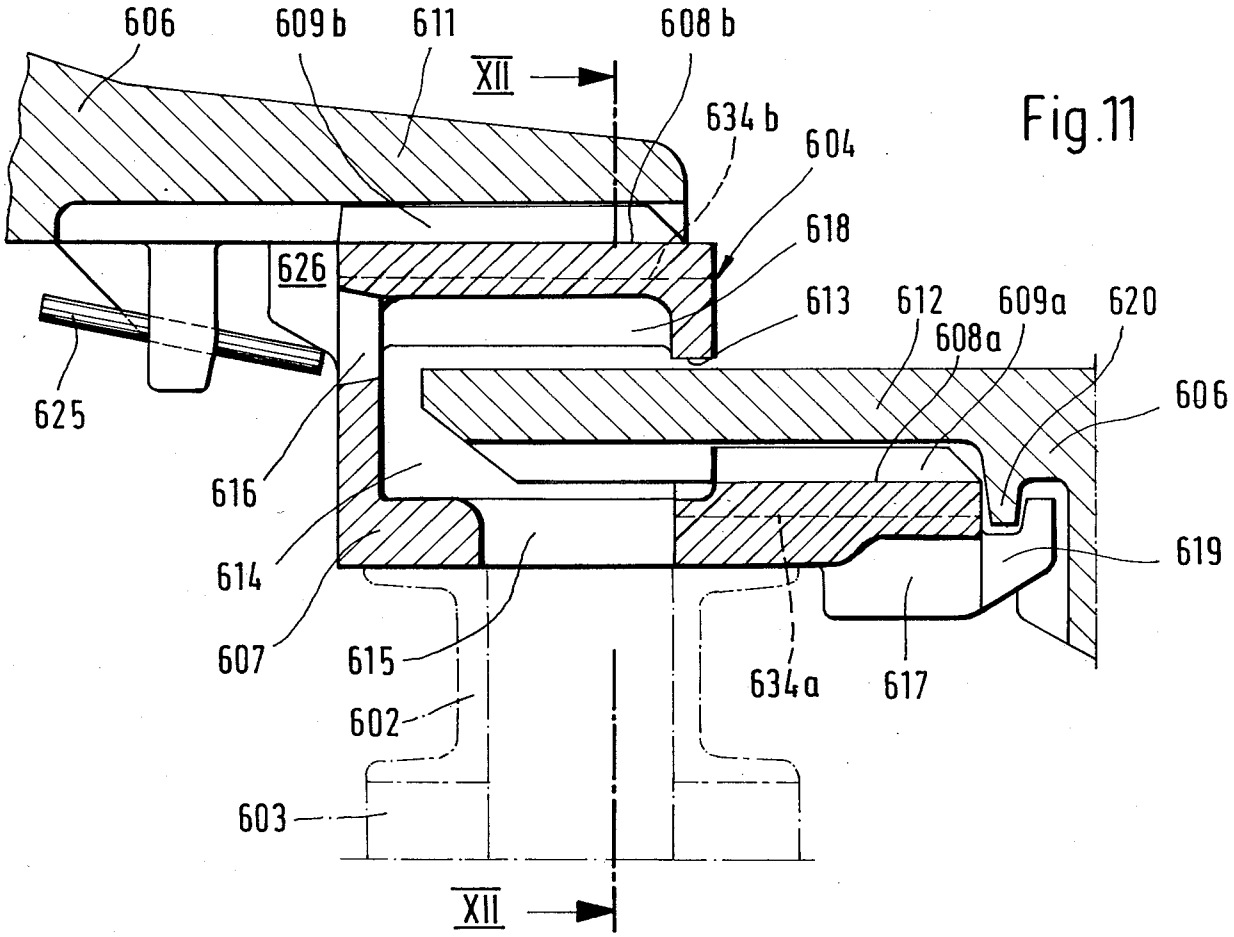
FIG. 11 is a cross-section taken along line XI—XI in FIG. 10.
Figure 12:
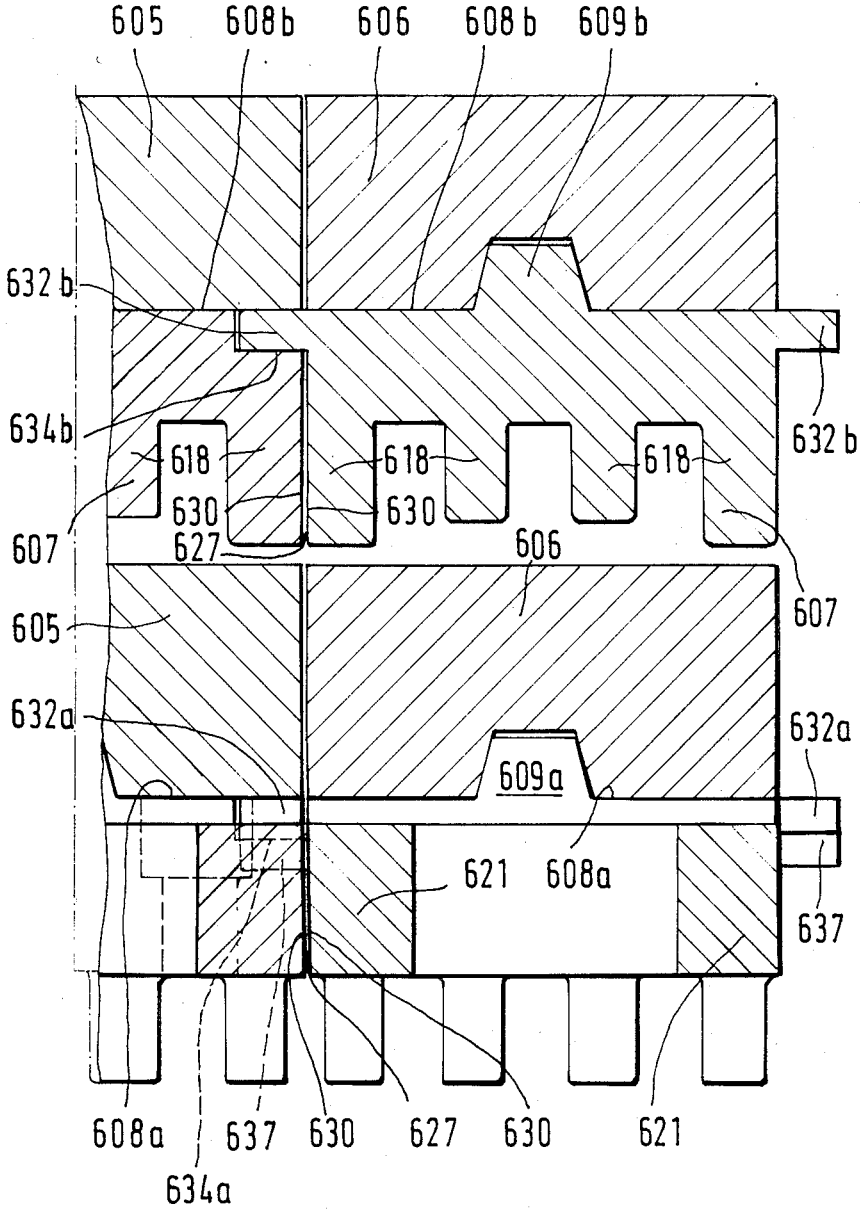
FIG. 12 is a cross-section taken along line XII—XII in FIG. 11.

In the sixth exemplary embodiment illustrated in FIGS. 10, 11 and 12, the two end surfaces of the outer grate beam sections 607 each have two upwardly open recesses **634*a* and 634*b*, which, as viewed from above, overlappingly extend over the entire width of the grate beam 604 at different elevations (FIGS. 10 and 11). The recesses 634*a* and 634*b* extend horizontally over the entire width of the mounting surfaces 608*a* and 608*b*. Projections 632*a* and 632*b* of the grate beam section 607 are adapted to the shape and height elevation of these recesses and engage in these recesses of the grate beam section 607 lying therebetween. As shown in FIG. 10, the two outer grate beam sections 607 are connected with the lower frame 603 by means of the above-described screw connections 628. The center grate beam section 607 is only suspended between the adjacent grate beam sections 607. In order to hold the center grate beam section 607 so that it essentially cannot move horizontally between the adjacent grate beam sections 607, respective interlock bars 637 are provided on the ends of the projections 632 for abutment against the opposing side surfaces of the adjacent grate beam sections 607**.

In a modified embodiment (not shown) of the sixth exemplary embodiment, two upwardly open recesses are provided on the two end surfaces of each grate beam section, which recesses, as described above with regard to the sixth exemplary embodiment, are provided at different elevations and extend over the entire width of the grate beam when viewed from above.

Aligned grate beam sections of this type form upwardly open channels. To cover the gaps between the grate beam sections, strips adapted to the shape of these channels are placed therein in such a manner that their upper side surfaces lie in a horizontal plane with the mounting surfaces of the grate beam sections. The embodiments of strips shown in the exemplary embodiments 2 through 5, for example, can be used for this purpose.

All embodiments of the first through fifth exemplary embodiments can also be used in the sixth exemplary embodiment, if the recesses in the grate beam sections are closed upwardly, rather than open.

Figure 13:
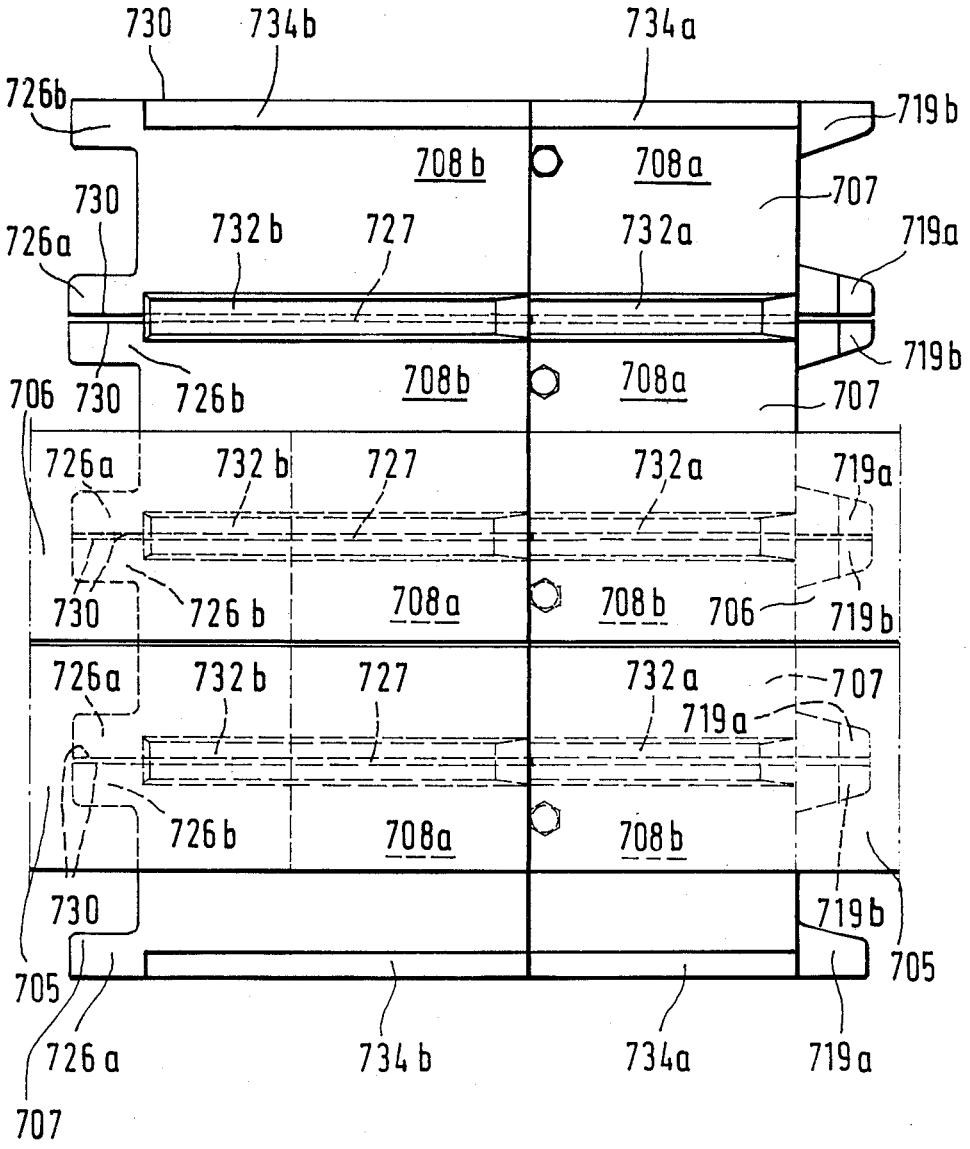
FIG. 13 is a plan view of a seventh exemplary embodiment of a grate beam comprised of four grate beam sections, whereby the ends of two pairs of grate bars are illustrated, which ends are supported by the grate bar sections shown in the lower part of the figure.

In the seventh exemplary embodiment illustrated in FIG. 13, the downstream lower-lying side surface of each grate beam section 707 has a half **719*a* and 719*b* of the hook-like projection 719 next to its two end surfaces, and the upstream higher-lying side surfaces thereof each has a half 726*a* and 726*b* of the nub 726 next to its two end surfaces 730. If the grate beam sections 706 in an assembled grate beam 704 abut each other, then the adjacent halves form the hook-like projections 719 and the nubs 726. The two end surfaces 730 of each grate beam section 707 each have two upwardly open recesses 734*a* and 734*b*, which, as viewed from above, overlappingly extend over the entire width of the grate beam 707 at different elevations (FIG. 13). In the assembled grate beam 704, the adjacent recesses 734*a* and 734*b* form two channels arranged one behind the other in the direction of conveyance. Strips 732*a* and 732*b* engage in these channels as covering means, which strips project above the mounting surfaces 708*a* and 708*b* and form ribs to hold or guide the grate bars 706 and 705**.

The strips **732*a* and 732*b* thereby are connected with the grate beam sections 707** in a manner described relative to the previous exemplary embodiments, for example by means of screws.

All of the exemplary embodiments described above can also be realized in grate beam sections having only one instead of two mounting surfaces. Grate beam sections of this type having only one mounting surface also are appropriate at the two ends of an inclined grate when the inclined grate has only two grate beams and one row of grate beams lying therebetween.

In addition, the recesses and the associated covering means in all of the exemplary embodiments do not need to run precisely horizontally. The decisive factor is that they cover the gaps and thus prevent hot fuel from falling onto the lower frame.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A furnace grate structure for conveying combusting solid fuel in a direction of conveyance, said structure comprising:

a plurality of grate bars for supporting the solid fuel, said grate bars extending substantially parallel to each other and substantially in said direction of conveyance, each of said grate bars having two ends;

a plurality of grate beams supporting said ends of said grate bars, said grate beams extending substantially parallel to one another and substantially transversely to said direction of conveyance and supported on a substructure;

at least one of said grate beams comprising a plurality of grate beam sections, each beam section having two ends, each end having an end surface, said grate beam sections being arranged end to end on said substructure to form one of said grate beams having gaps between adjacent grate beam sections, said gaps being covered by covering means;

characterized in that at least one of said end surfaces of at least one of said grate beam sections has at least one recess to receive said covering means.

2. The furnace grate structure according to claim 1, wherein at least one end surface of at least one grate beam section has two recesses to receive covering means, which recesses are arranged at different elevations and extend in such a manner that the covering means engaging therein cover the gaps between adjacent grate beam sections.

3. The furnace grate structure according to claim 1, wherein at least one recess is upwardly open.

4. The furnace grate structure according to claim 1, wherein at least one grate beam section has at least one recess formed on each of its two end surfaces.

5. The furnace grate structure according to claim 4, wherein the recesses formed on adjacent grate beam sections are arranged at the same elevation in both end surfaces of said adjacent grate beam sections, so that said grate beam sections form a channel to receive a strip serving as a covering means on the adjacent end surfaces of the grate beam sections.

6. The furnace grate structure according to claim 5, in said grate beam sections having recesses arranged at both end surfaces, said recesses are arranged at the same elevation on its two end surfaces, so that said grate beam sections are symmetrical with regard to the vertical center plane of said grate beam sections running parallel to the direction of conveyance.

7. The furnace grate structure according to claim 1, wherein at least one grate beam section has on at least one end surface at least one projection for engagement with the recess in the end surface of an adjacent grate beam section.

8. The furnace grate structure according to claim 1, wherein holding means are provided for connecting the covering means with the grate beam sections.

9. The furnace grate structure according to claim 8, wherein the holding means is formed by at least one interlock means provided on the covering means, which interlock means prevents a relative horizontal shifting movement between the grate beam which is not connected with the holding means and the covering means.

10. The furnace grate structure according to claim 1, further including interlock means in the form of ribs on the upper side of the grate beam sections, which ribs engage in recesses in the grate bars, for the mounting of the grate bars on the grate beam sections.

11. The furnace grate structure according to claim 10, wherein at least two recesses are formed on adjacent beam sections, and said recesses formed on adjacent end surfaces of two adjacent beam sections are upwardly open, so that said adjacent beam sections form at least one upwardly open channel to receive at least one strip serving as said covering means on said adjacent end surface of said two beam sections, said strip forming said rib on the upper side of said at least two grate beam sections.

12. The furnace grate structure according to claim 11, wherein each of said two adjacent beam sections has two mounting surfaces for the mounting of adjacent ends of grate bars arranged upstream and downstream in said direction of conveyance, said mounting surface for said end of said grate bar arranged downstream lies lower than said mounting surface for said end of said grate bar arranged upstream, said both mounting surfaces overlap each other, said upwardly open recesses are formed in each of said mounting surfaces so that said adjacent great beam sections form two overlapping channels to receive two overlapping strips, each of said strips forming a rib on the upper side of each of said mounting surfaces for engagement in said recesses of said grate bars arranged upstream and downstream of said grate beam sections.

* * * * *